United States Patent [19]

Janson

[11] Patent Number: 4,546,236

[45] Date of Patent: Oct. 8, 1985

[54] WALL MOUNTING ARRANGEMENT FOR SAUNA HEATING UNITS

[75] Inventor: Mats O. Janson, Biel-Bienne, Switzerland

[73] Assignee: Tylo Sauna S.A., Biel-Bienne, Switzerland

[21] Appl. No.: 478,855

[22] Filed: Mar. 25, 1983

[30] Foreign Application Priority Data

Apr. 7, 1982 [SE] Sweden ..... 8202243

[51] Int. Cl.[4] ..... A61H 33/06; F24H 9/06; H05B 1/00

[52] U.S. Cl. ..... 219/365; 4/524; 219/366; 248/201; 248/233; 312/245; 312/249

[58] Field of Search ..... 219/362, 365–368; 4/524–534; 248/200, 201, 232, 233; 312/242, 245, 246, 249, 236, 238, 243, 256

[56] References Cited

U.S. PATENT DOCUMENTS

| | | | |
|---|---|---|---|
| 1,914,974 | 6/1933 | McGrail | 248/232 |
| 1,944,687 | 1/1934 | Henderson | 312/245 |
| 1,997,249 | 4/1935 | Dobbs | 4/524 |
| 2,535,424 | 12/1950 | Josephson | 219/368 |
| 2,851,325 | 9/1958 | Moor | 312/245 |
| 3,131,010 | 4/1964 | Erath | 312/243 |
| 3,147,367 | 9/1964 | Magnusson | 219/366 |
| 3,309,501 | 3/1967 | Jansson | 219/365 |
| 3,337,715 | 8/1967 | Finn | 4/524 |
| 3,530,277 | 9/1970 | Kujansuu | 219/368 |
| 3,531,623 | 9/1970 | Teeri | 219/367 |
| 3,708,651 | 2/1973 | Neville | 219/365 |
| 3,786,231 | 1/1974 | Torvfelt | 219/365 |
| 4,296,507 | 10/1981 | Janson | 4/524 |

FOREIGN PATENT DOCUMENTS

| | | | |
|---|---|---|---|
| 2362672 | 6/1975 | Fed. Rep. of Germany | 248/232 |

*Primary Examiner*—Roy N. Envall, Jr.
*Assistant Examiner*—Geoffrey S. Evans
*Attorney, Agent, or Firm*—Holman & Stern

[57] ABSTRACT

A sauna heating unit including electrical heating elements (17), which are surrounded by a casing (11) open at the top and at the bottom, elements (17) being regulatable and connectable and disconnectable through control elements (15,16) arranged on a control panel (14) on one side of the unit. The unit through brackets (19), are mountable on a wall. The sauna unit in a few steps can be changed to right-hand or left-hand versions and is constructed and supported so that the outer casing and the inner shield are practically unloaded, and heat transmitting connections can be avoided. Brackets (19) are detachably connectable to the upper and/or lower free end of the unit at alternative angles, parallel or approximately parallel to the sidewalls of the stone holder (13).

13 Claims, 5 Drawing Figures

WALL MOUNTING ARRANGEMENT FOR SAUNA HEATING UNITS

The present invention concerns a sauna heating unit comprising electrical heating elements which are surrounded by at least one casing open at the top and the bottom and which elements can be regulated and connected and disconnected through control means arranged on a control panel attached on one side of the heating unit, and which unit can be mounted on a wall using detachable brackets or the like.

DESCRIPTION OF THE PRIOR ART

Field Of The Invention

An effort to simplify mounting and installation work on sauna heating units has lead to the result that the control panel previously mounted outside the sauna is now more commonly placed in direct contact with the sauna heater. The wiring to the heater is considerably simplified in this way and the heater can be delivered from the factory as a complete unit which need only be coupled to the electricity supply network.

Considering that the heater must be placed in and adapted to the local conditions in the often very cramped sauna room it is appropriate that the control panel is mounted on one gable wall of the sauna heater. This means however that the units must be made in right-hand and left-hand versions, which has caused an increase in the price of the product and considerable storage problems in all parts of the sales organization.

Another problem which has not yet been solved is concerned with the construction of the sauna heater and method of mounting it on a wall using brackets which hold the heater at a safe distance from the wall with respect to fire danger. The brackets for supporting the heater have until now been attached to the outer casing of the heater, which means that relatively strong weight, transmitting members are needed between the outer casing and the inner shield and from there to the stone holder, which is exposed to the greatest stresses, both in respect to temperature, that is the expansion and contraction of the material, and in respect to weight. Load carrying members between the casing, cover and stone holder of the sauna heater must necessarily be of metal and thus are heat conductors, which means that the outer casing cannot be held at the low temperature which would be possible if the metal connections could be broken between these parts.

BRIEF SUMMARY OF THE INVENTION

The purpose of the present invention is to achieve a sauna heating unit which in only a few steps can be changed from right-hand to left-hand version and which is so constructed and mounted that the outer casing and the inner shield are practically unloaded, whereby heat transmitting connections can be avoided. These objects have been solved by making the brackets detachably connectable at least to the upper side of the heater at alternative angles to two opposite sides of the stone holder.

BRIEF DESCRIPTION OF THE DRAWING

The invention will now be described in greater detail with reference to the accompanying drawings wherein.

DETAILED DESCRIPTION

Figure 1:
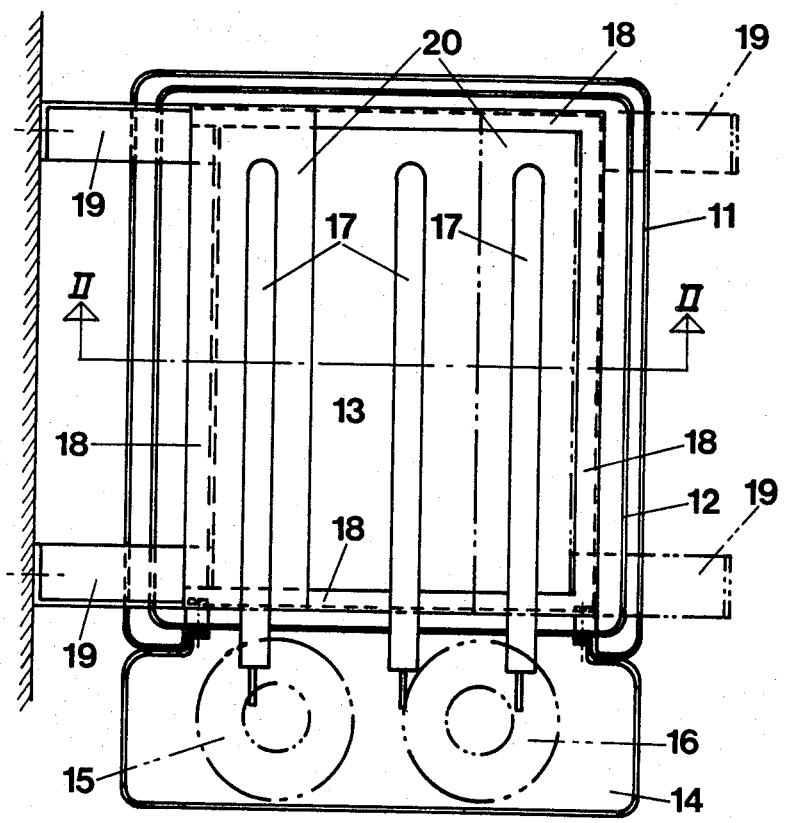
FIG. 1 is a top plan view of the sauna heater according to the invention.

The sauna heater according to the invention consists in a known way of an outer casing 11, an inner shielding wall 12 and inside it a stone holder 13. The outer casing 11 and the shielding wall 12 are U-shaped plates, while the stone holder consists of a perforated container with side walls 10 and bottom 9. Between the shanks of the U-shaped outer casing and the shielding wall an end wall 14 in the form of a control panel can be screwed tight, which end wall is large enough to contain control devices such as a timer 15 and a thermostat 16 for controlling and regulating the heating elements 17 of the sauna heater. These are electrically connected to a connection plinth placed in the control panel 14 in such a way that if it is removed from the heater the heating elements 17 will come with the control panel.

Figure 2:
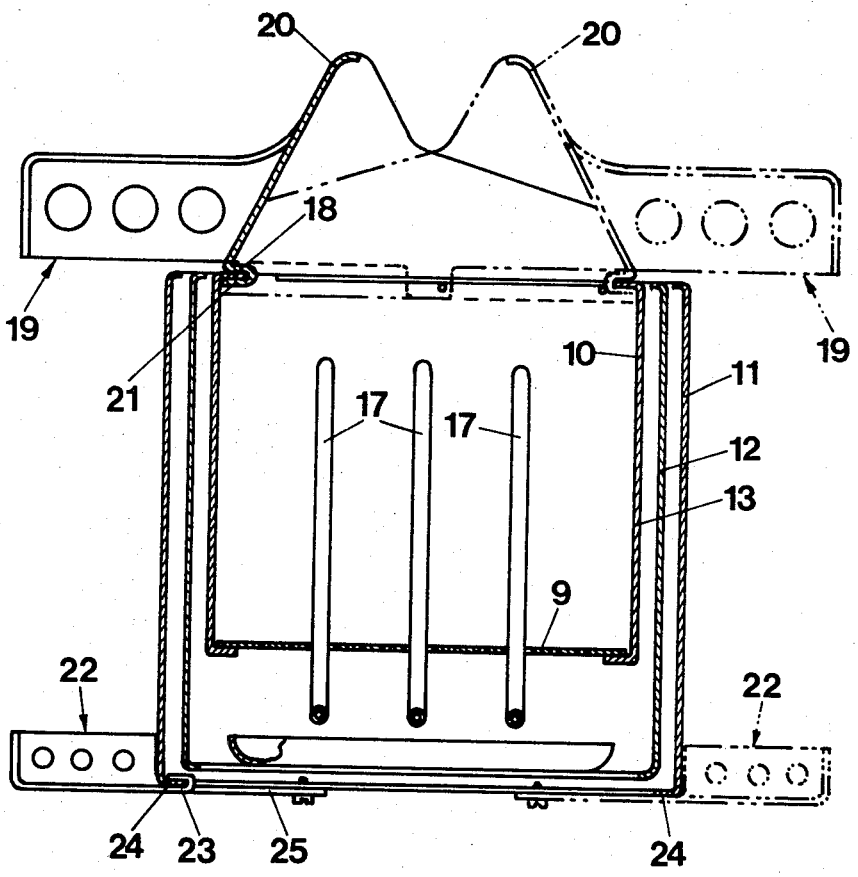
FIG. 2 is a cross-section view taken along line II—II in FIG. 1.
Figure 3:
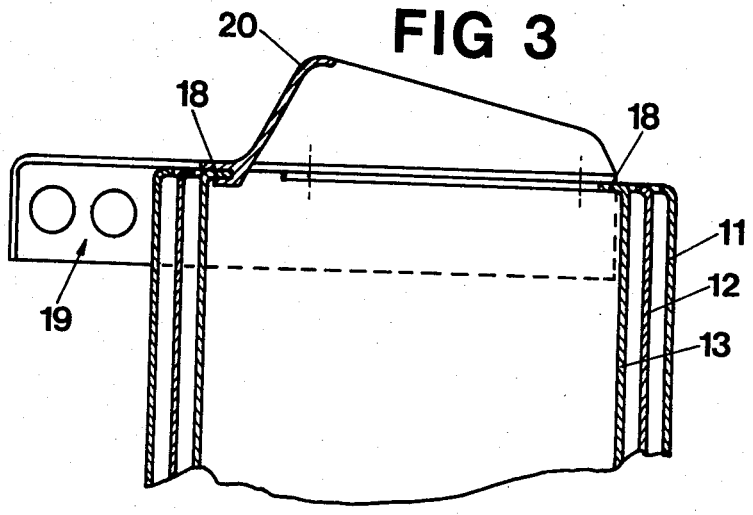
FIGS. 3 and 4 are cross-sectional views similar to FIG. 2 showing two alternative embodiments of the invention.

The stone holder 13 is provided at its upper edge with an encircling inwardly directed flange 18, which in the embodiment shown is arranged for supporting the entire sauna heater. Two brackets 19 are attachable to said flange. The brackets in the embodiments according to FIGS. 1, 2 and 3 are built together with a radiation shield 20. The bracket 19 and the radiation shield 20 are provided with a groove 21 extending in the longitudinal direction of the radiation shield, in which groove one of the flanges 18 at the upper edge of the stone holder is to be inserted, more specifically the edge which is placed nearest the wall against which the sauna heater is to be mounted. The front end of the bracket and possibly its middle part are attached with screws or the like to the side wall 10 of the stone holder or that part of the flange 18 which is arranged at right angles to the previously mentioned flange.

Depending on whether a left-hand or right-hand version of the sauna heater is desired, the brackets and the radiation shield are arranged in at least two alternative postions at 180° angle to each other, and if the heater is square shaped even a third position is possible.

Figure 4:
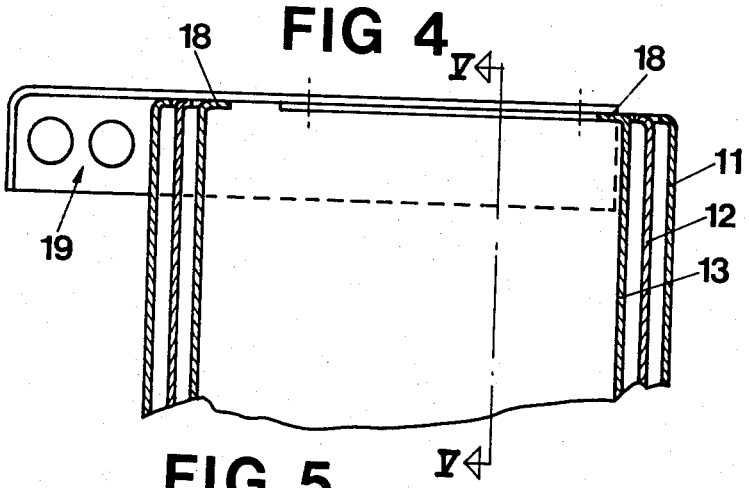
Figure 5:
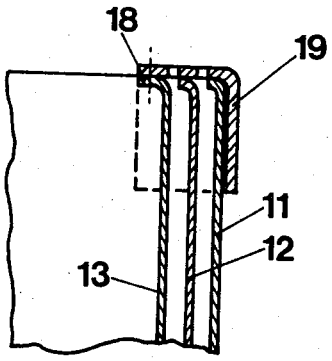
FIG. 5 is a cross-sectional view taken along line V—V in FIG. 4.

For the embodiments according to FIGS. 1 and 2 the brackets 19 are placed above the heater and at the level of the radiation shield. For the embodiment according to FIGS. 3 and 4 the brackets are placed at the side of and preferably in direct contact with the two end walls of the sauna heater. In FIG. 3 is shown an embodiment with a connecting radiation shield 20, while the embodiment in FIGS. 4 and 5 lacks a radiation shield, but can be provided with a detachable one.

To reduce the load on the brackets 19 it is appropriate to provide supporting legs 22 at the lower part of the heater arranged preferably opposite the brackets, which legs can either be attached directly to the wall and only loosely press against the outer casing 11, or also be attached to it. To avoid making holes in the surface of the outer casing 11 the supporting leg can be shaped as shown in FIG. 2, where the supporting leg is connected to the outer casing 11 in a way similar to the way in which the bracket 19 is connected to the stone holder 13. The supporting leg is thus provided with a clamp 23 which can be placed over the inward folded flange 24 of the outer casing 11 which is provided at its lower part.

The supporting leg is further provided with an extension 25 which using a screw or the like can be affixed to the flange 24. In cases where the stone holder reaches all the way down to the bottom edge of the heater the supporting legs can also be attached to this if desired.

By connecting the brackets 19 directly to the stone holder, that is the heaviest part of the sauna heating unit, a very favorable distribution of the resulting stresses is obtained, both mechanical stresses and thermal stresses during heating of the unit, whereby the inner shielding wall 12 and the outer casing 11 can expand and contract freely, because they are not part of the support of the heavy stone holder. In a simple way using spacing blocks of a material which conducts heat poorly the outer casing and the shielding wall can be kept at a distance from each other and affixed to the stone holder without obtaining any significant thermal paths. Through the special construction of the heater and the brackets it is further possible to turn the brackets in a few steps so that they are pointed in opposite directions, so that for example a previously right-hand version can be changed to a left-hand version, that is a heater where the control panel is placed on the left side.

The invention is not limited to the embodiments shown and described but a number of modifications are possible within the scope of the claims.

I claim:

1. A sauna heating unit comprising:

electrical heating elements;

at least one casing having an open upper side and an open lower side and surrounding said heating elements;

a stone holder arranged within and connected to said casing, said stone holder, said stone holder having oppositely disposed walls;

means to support said electrical heating elements within said casing;

a control panel attached on one side of the heating unit;

control means for electrically connecting and disconnecting said heating elements to and from a source of electric power and for regulating said heating elements, said control means being supported by said control panel;

detachable brackets for mounting the sauna heating unit on a wall; and means for detachably connecting said brackets to said stone holder at least at the upper side of the heating unit comprising connection members on said oppositely disposed wall of the stone holder for optionally connecting said brackets to the stone holder in at least two positions so that the heating unit can be reversibly mounted on the wall with the control panel in positions substiantially 180° with respect to each other.

2. A sauna heating unit as claimed in claim 1 wherein:

said stone holder has an upper side;

said connection members are on said upper side of said stone holder; and further comprising a radiation shield formed as an integral part of said bracket and being detachably connectable to said connection members on the upper side of said stone holder.

3. A sauna heating unit as claimed in claim 2 wherein:

said connection members extend over a substantial part of the periphery of said stone holder on said upper side thereof; and said means for detachably connecting said brackets to said stone holder further comprise connection members on said brackets interlockable with said connection members on said stone holder.

4. A sauna heating unit as claimed in claim 1 wherein:

said connection members extend over a substantial part of the periphery of said stone holder on said upper side thereof; and said means for detachably connecting said brackets to said stone holder further comprises connection members on said radiation shield interlockable with said connection members on said stone holder.

5. A sauna heating unit as claimed in claim 3 wherein:

said stone holder has upper edges;

said connection members on said stone holder comprise inturned flanges on said upper edges; and said connection members on said brackets comprise a substantially U-shaped groove into which said internal flanges are insertable in interlocking relationship therewith.

6. A sauna heating unit as claimed in claim 5 wherein:

said at least one casing is a U-shaped plate;

said stone holder is perforated; and a shielding wall in the form of a U-shaped plate is provided between and in spaced relation with respect to said casing and stone holder.

7. A sauna heating unit as claimed in claim 1 and further comprising:

means to support said at least one casing in surrounding relationship with respect to said heating elements and said stone holder.

8. A sauna heating unit as claimed in claim 6 and further comprising:

means to support said at least one casing in surrounding relationship with respect to said heating elements and said stone holder.

9. A sauna heating unit as claimed in claim 1 wherein:

said electrical heating elements are disposed within said stone holder.

10. A sauna heating unit as claimed in claim 1 wherein:

said electrical heating elements are supported by said control panel.

11. A sauna heating unit as claimed in claim 9 wherein:

said electrical heating elements are supported by said control panel.

12. A sauna heating unit as claimed in claim 8 wherein:

said electrical heating elements are disposed within said stone holder.

13. A sauna heating unit as claimed in claim 12 wherein:

said electrical heating elements are supported by said control panel.

* * * * *